US012371078B2

(12) United States Patent
Angel et al.

(10) Patent No.: US 12,371,078 B2
(45) Date of Patent: Jul. 29, 2025

(54) VEHICLE MONITORING SYSTEM

(71) Applicant: Westinghouse Air Brake Technologies Corporation, Wilmerding, PA (US)

(72) Inventors: Kevin Angel, Marion, IA (US); Ann Grimm, Cedar Rapids, IA (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 1050 days.

(21) Appl. No.: 16/725,504

(22) Filed: Dec. 23, 2019

(65) Prior Publication Data

US 2021/0188333 A1 Jun. 24, 2021

(51) Int. Cl.

| | |
|---|---|
| ***B61L 25/02*** | (2006.01) |
| ***B61L 15/00*** | (2006.01) |
| ***B61L 23/34*** | (2006.01) |
| ***B61L 25/04*** | (2006.01) |

(52) U.S. Cl.

CPC ..... *B61L 15/009* (2013.01); *B61L 15/0045* (2013.01); *B61L 15/0072* (2013.01); *B61L 23/34* (2013.01); *B61L 25/025* (2013.01); *B61L 25/04* (2013.01)

(58) Field of Classification Search

CPC .... B61L 3/008; B61L 15/009; B61L 15/0045; B61L 15/0072; B61L 23/34; B61L 25/025; B61L 25/04; B61L 2205/04

See application file for complete search history.

(56) References Cited

U.S. PATENT DOCUMENTS

| | | | | |
|---|---|---|---|---|
| 7,398,140 | B2 | 7/2008 | Kernwein | |
| 8,478,463 | B2 | 7/2013 | Grimm | |
| 9,008,933 | B2 * | 4/2015 | Cooper | B61L 27/16 701/70 |
| 9,168,936 | B2 | 10/2015 | Grimm | |
| 2004/0015276 | A1 | 1/2004 | Kane | |
| 2012/0280837 | A1 * | 11/2012 | Clements | B61L 27/20 701/2 |
| 2012/0290182 | A1 * | 11/2012 | Cooper | B61L 27/16 701/70 |
| 2013/0131968 | A1 * | 5/2013 | Wills | G08G 9/00 705/7.12 |
| 2017/0043799 | A1 * | 2/2017 | Shubs | B61L 27/57 |
| 2017/0148323 | A1 * | 5/2017 | Shubs, Jr. | B61L 27/10 |

(Continued)

OTHER PUBLICATIONS

Office Action for corresponding MX Application No. MX/a/2021/000048 dated Dec. 4, 2023 (5 pages).

*Primary Examiner* — Zachary L Kuhfuss

(74) *Attorney, Agent, or Firm* — K&L Gates LLP

(57) ABSTRACT

A vehicle monitoring system and method receive a selection of at least one vehicle-of-interest onboard a vehicle system moving along one or more routes in a transportation network. The at least one vehicle-of-interest is disposed on the one or more routes in the transportation network. One or more locations of the at least one vehicle-of-interest are monitored from onboard the vehicle system. The one or more locations of the at least one vehicle-of-interest are displayed on a display device disposed onboard the vehicle system. A determination is made whether to change display of the one or more locations of the at least one vehicle-of-interest on the display device based on an update to a notified state of the at least one vehicle-of-interest being received onboard the vehicle system.

18 Claims, 7 Drawing Sheets

(56) References Cited

U.S. PATENT DOCUMENTS

| | | | | |
|---|---|---|---|---|
| 2017/0210404 | A1* | 7/2017 | Brooks | B61L 23/34 |
| 2017/0308080 | A1* | 10/2017 | Brooks | G05D 1/0027 |
| 2018/0290673 | A1* | 10/2018 | Chu | G08G 1/123 |
| 2018/0356814 | A1* | 12/2018 | Brooks | G05D 1/0027 |
| 2020/0198677 | A1* | 6/2020 | Dreasher | B61L 27/04 |

* cited by examiner

VEHICLE MONITORING SYSTEM

BACKGROUND

Technical Field

The subject matter described herein relates to systems and methods that monitor movements of vehicle systems.

Discussion of Art

Vehicle control systems can control movements of vehicle systems formed from one or more vehicles based on operator input and external factors. These external factors can include speed limits, obstructions on a route, capabilities of the vehicle systems, or the like.

An additional factor that may dictate how a vehicle system moves is the presence and/or movement of other vehicle systems. For example, a first vehicle system may need to coordinate movement of the first vehicle system with the location and/or movement of a second vehicle system. This can occur when these vehicle systems need to coordinate a meet-and-pass event, a meet-and-overtake event, or the like. The first vehicle system may not be able to pass or overtake the second vehicle system on a first route until the second vehicle system is moved onto a second route, such as a siding. As another example, the first vehicle system may not be able to enter into a segment of a route until the second vehicle system moves out of that segment of the route.

The locations and/or movements of other vehicle systems may be manually monitored by an operator onboard a vehicle system. Optionally, these locations and/or movements of the other vehicle systems can be monitored by computerized monitoring systems. These monitoring systems can have a limited capabilities. For example, the distance or range over which the other vehicle systems can be tracked may be limited, the information available to these monitoring systems can be limited, and the like.

BRIEF DESCRIPTION

In one embodiment, a method includes receiving a selection of at least one vehicle-of-interest onboard a vehicle system moving along one or more routes in a transportation network. The at least one vehicle-of-interest is disposed on the one or more routes in the transportation network. The method also includes monitoring one or more locations of the at least one vehicle-of-interest from onboard the vehicle system, displaying the one or more locations of the at least one vehicle-of-interest on a display device disposed onboard the vehicle system, and determining whether to change display of the one or more locations of the at least one vehicle-of-interest on the display device based on an update to a notified state of the at least one vehicle-of-interest being received onboard the vehicle system.

In one embodiment, a system includes one or more processors configured to determine at least one vehicle-of-interest onboard a vehicle system moving along one or more routes in a transportation network. The at least one vehicle-of-interest is disposed on the one or more routes in the transportation network. The one or more processors are configured to monitor one or more locations of the at least one vehicle-of-interest from onboard the vehicle system and to direct display of the one or more locations of the at least one vehicle-of-interest on a display device disposed onboard the vehicle system. The one or more processors also are configured to determine whether to change display of the one or more locations of the at least one vehicle-of-interest on the display device based on an update to a notified state of the at least one vehicle-of-interest being received onboard the vehicle system.

In one embodiment, a system includes one or more processors configured to be disposed onboard a first vehicle system moving along a route. The one or more processors are configured to identify a second vehicle system moving along the route and to monitor a changing state of the second vehicle system based on a signal received from one or more of the second vehicle system or an off-board control system. The one or more processors are configured to direct a display device to present the changing state of the second vehicle system onboard the first vehicle system to an operator of the first vehicle system.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the inventive subject matter described herein relate to vehicle monitoring systems and methods that receive input to identify a vehicle-of-interest, track the position of that vehicle, and present the position(s) of that vehicle (e.g., on an onboard display device). The monitoring system can be used in a variety of different types of vehicle systems to monitor the locations and/or movements of other vehicle systems. While some description herein relates to rail vehicle systems, not all embodiments of the inventive subject matter are restricted to rail vehicle systems. One or more embodiments of the subject matter described herein can be used with automobiles, trucks, buses, aircraft, marine vessels, mining vehicles, agricultural vehicles, or other off-highway vehicles.

Figure 1:
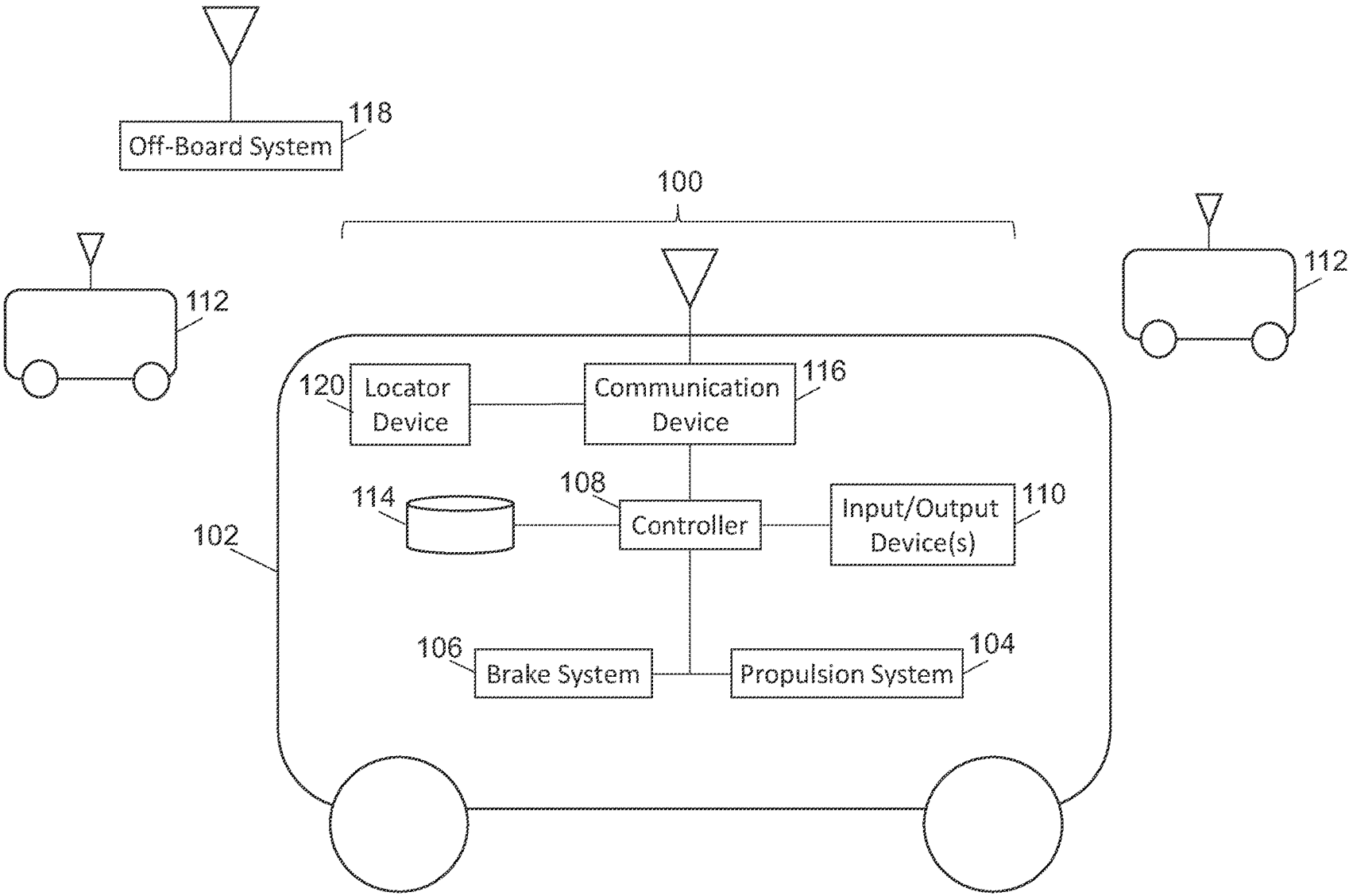
FIG. 1 illustrates one example of a vehicle monitoring system.

FIG. 1 illustrates one example of a vehicle monitoring system 100. The monitoring system can be entirely or partially disposed on a vehicle system 102, such as a rail vehicle (e.g., locomotive, transit vehicle, rail car, subway car, etc.), automobile, or the like. The vehicle system may be a single vehicle system or multiple vehicle system. For example, the vehicle system may be formed from two or more vehicles. These vehicles may be mechanically coupled with each other (e.g., by couplers) or may not be mechanically coupled (but logically coupled such that the vehicles communicate with each other to coordinate their movements with each other to travel together, as in a convoy). The vehicle system can include a propulsion system 104 and/or a brake system 106. The propulsion system can include components that propel the vehicle system, such as one or more engines, motors, propellers, or the like. The brake system can include components to slow or stop movement of the vehicle system, such as one or more friction brakes, air brakes, motors (e.g., using regenerative braking to slow or stop movement), or the like.

The monitoring system includes a controller 108 that represents hardware circuitry including and/or connected with one or more processors (e.g., one or more microprocessors, integrated circuits, field programmable gate arrays, etc.). The controller can receive input that identifies a vehicle-of-interest to be tracked. For example, the monitoring system can include one or more input and/or output devices 110 ("Input/Output Device(s)" in FIG. 1) that provide an identification of the vehicle-of-interest. This input/output device can represent a touchscreen, other display device, keyboard, button, switch, microphone, or the like. The input/output device can receive input from an operator onboard, from the controller, from another component of the vehicle system, or the like, that identifies one or more other vehicle systems 112 to be monitored. The vehicle system to be monitored is referred to as the vehicle-of-interest.

Figure 2:
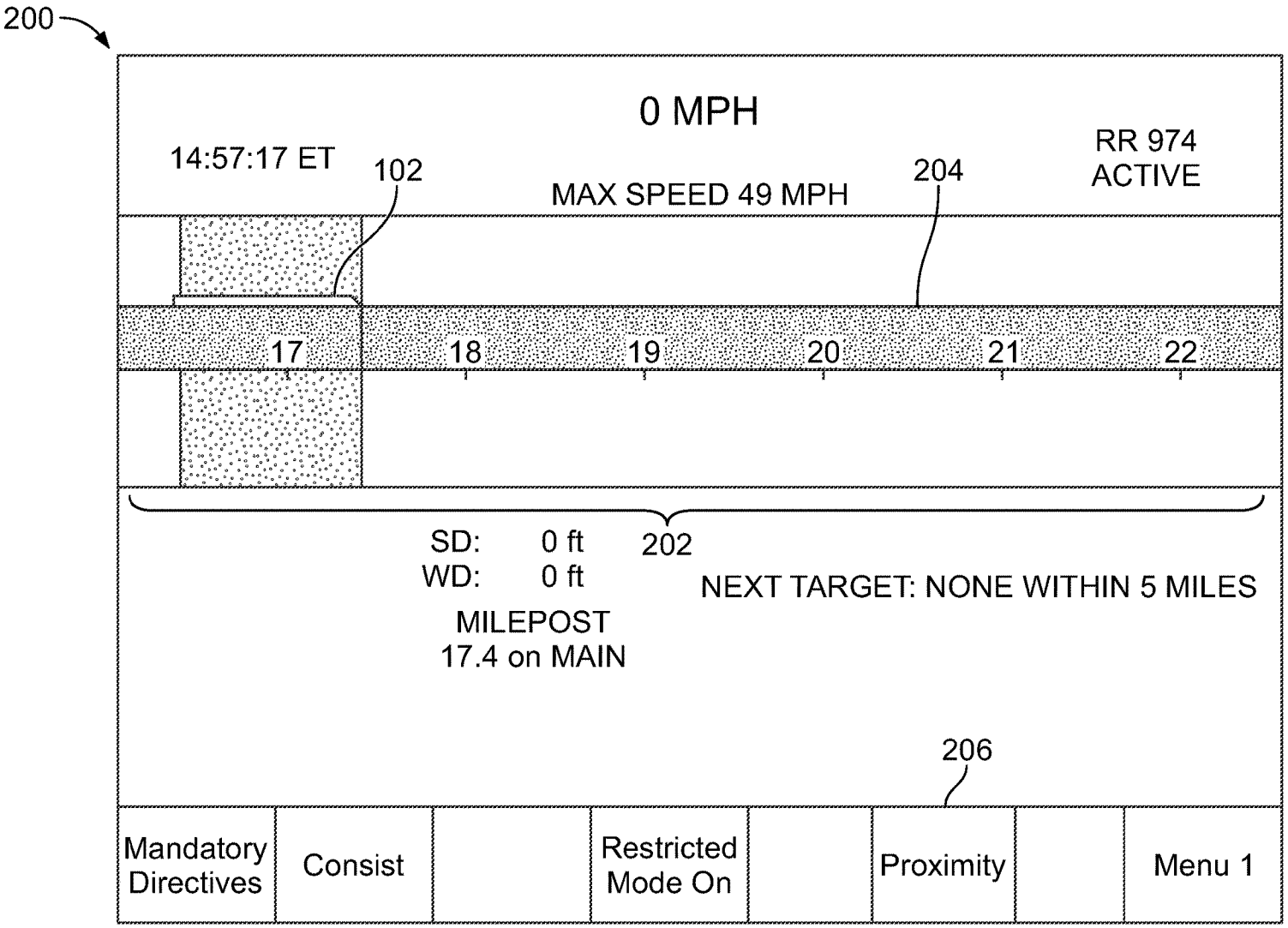
FIG. 2 illustrates one example of a graphical user interface (GUI) generated by the monitoring system shown in FIG. 1.

FIG. 2 illustrates one example of a GUI 200 that can be generated by the monitoring system shown in FIG. 1 on the input/output device also shown in FIG. 1. The controller can direct the input/output device to display the GUI 200 to show a segment 202 of a route 204 on which the vehicle system 102 is located. The controller can direct the input/output device to display the GUI shown in FIG. 2 to receive an operator selection of a vehicle-of-interest. In the illustrated example, the operator can select a graphical object 206, such as a "Proximity" button, to receive the operator selection of a vehicle-of-interest. The vehicle-of-interest is another vehicle or vehicle system that is tracked by the monitoring system.

Figure 3:
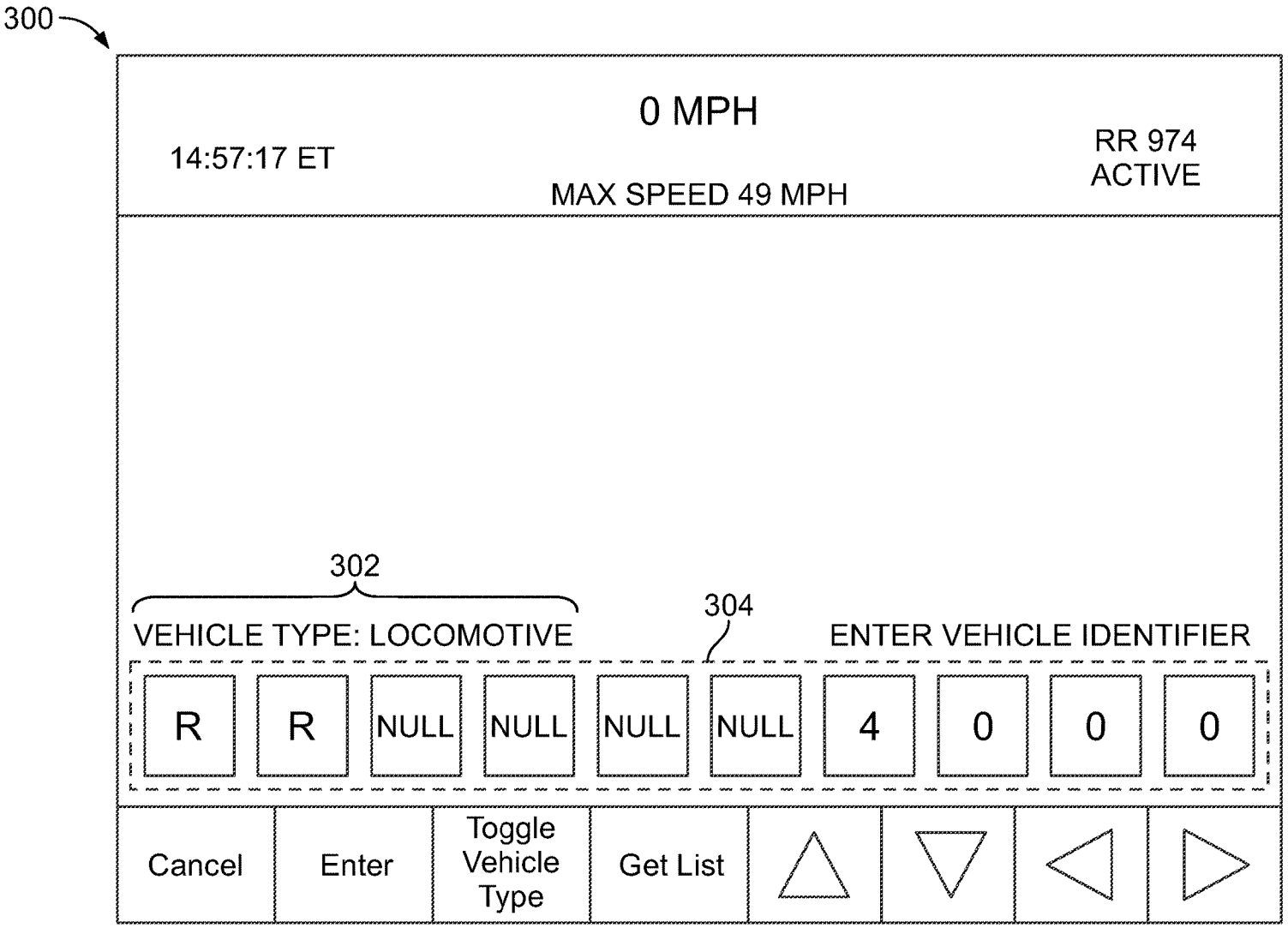
FIG. 3 illustrates one example of another GUI that can be displayed to receive an operator selection of a vehicle-of-interest.

FIG. 3 illustrates one example of another GUI 300 that can be displayed to receive an operator selection of the vehicle-of-interest. Responsive to the input/output device(s) receiving the selection of the graphical object 206, the controller can direct the input/output device to display the GUI 300. The operator can use the input/output device to provide a type 302 and/or an identifier 304 of the vehicle-of-interest. The type of the vehicle-of-interest can be information that identifies a category, model, or the like, of the vehicle-of-interest. For example, the type can be a locomotive, car, truck, bus, subway car, or the like. The identifier can be an identification number or string, a serial number, a name, or the like. The identifier can be unique to the vehicle-of-interest or may be shared among different vehicles at different times (e.g., a flight number).

A tangible and non-transitory computer-readable storage medium (a computer memory 114 shown in FIG. 1) onboard the vehicle system 102 (or off-board the vehicle system 102 but accessible by the controller) can store vehicle types and/or identifiers. The controller can access this memory 114 to determine which vehicle types and/or identifiers are associated different vehicles or vehicle systems.

Figure 4:
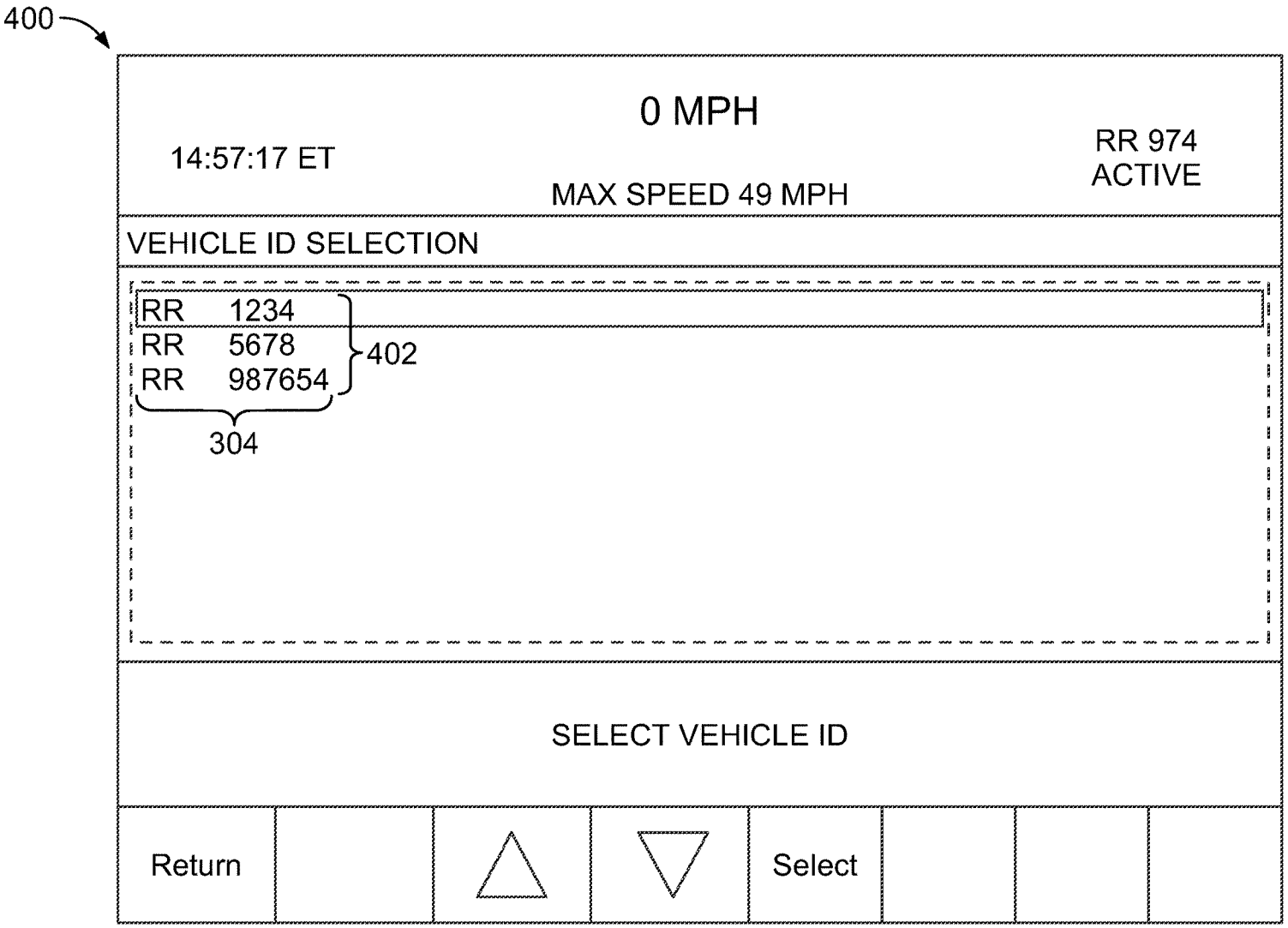
FIG. 4 illustrates another example of a GUI that can be presented by the monitoring system shown in FIG. 1.

The controller can direct the input/output device to provide an operator with a list or set of vehicles for selection as the vehicle-of-interest. FIG. 4 illustrates another example of a GUI 400 that can be presented by the input/output device. In this GUI, a list 402 of vehicles are provided that may be selected by the operator as the vehicle-of-interest. The vehicles may be identified in the list by the type 302 and identifier 304 described above. The model type indicates the type of vehicle (e.g., rail vehicle, maintenance vehicle, automobile, etc.) and the identifier can be the unique identifier of the corresponding vehicle.

The controller can determine which vehicle systems 112 to display in the list based on signals received from an off-board system 118. The off-board system can represent a computerized system that can communicate with the vehicle systems 102, 112 and monitor one or more locations of other vehicles. As one example, the off-board system can be a back office server of a positive control system. A positive control system can monitor locations of vehicles moving throughout a transportation network formed of interconnected routes. The positive control system can send signals to the vehicle systems to notify or inform the vehicle systems where the vehicle systems are permitted to travel. For example, the positive control system can determine which route segments are occupied by other vehicles, are undergoing maintenance, have a reduced speed limit, or the like. The positive control system can communicate signals to the vehicle systems informing the vehicle system of which route segments that the vehicle systems are allowed to enter based on the monitored conditions. Unless and until a vehicle system receives a signal from the positive control system informing the vehicle system that the vehicle system can enter into a route segment, the controller of the vehicle system does not allow the vehicle system to enter into that route segment. For example, in the absence of receiving a signal providing permission to enter into a route segment, the controller may automatically control the propulsion system and/or the brake system to prevent the vehicle system from entering the route segment. One example of a positive control system is a positive train control system.

As another example, the off-board system can be a back office server of a negative control system. Similar to the positive control system, the negative control system can monitor locations of vehicle systems and other conditions to notify the vehicle systems whether the vehicle systems are allowed to enter into a route segment. In contrast to the positive control system, a vehicle system may enter into a route segment unless or until the negative control system sends a signal to the vehicle system prohibiting that vehicle system from entering into the route segment.

Optionally, the off-board system can be a scheduling system of a transportation network formed from interconnected routes that the vehicle systems travel along. The off-board system can be a dispatch system or facility of the transportation network. As another example, the off-board system can be a traffic monitoring system, such as one or more computer servers that track the flow and/or density of traffic in different areas.

The controller onboard the vehicle system 102 can receive signals from the off-board system that indicate what other vehicle systems 112 are within a designated distance of the vehicle system 102. The controller can report the location of the vehicle system to the off-board system. For example, the monitoring system can include a locator device 120 that outputs one or more signals indicative or representative of locations of the vehicle system 102. The locator device can represent a global positioning system receiver, a dead reckoning device, a wireless triangulation device, an input device (that receives operator input indicating a location), an optical sensor (e.g., a camera that captures images or video of mileposts, signs, or the like), etc.

The controller can send a signal to the off-board system informing the off-board system of the location of the vehicle system 102. The off-board system can include one or more processors that determine what other vehicle systems 112 are within a threshold distance of the vehicle system 102 based on this received location. For example, the other vehicle systems 112 can include locator devices 120 and communication devices (described below) to report the locations of the vehicle systems 112 to the off-board system. The off-board system can determine what vehicle systems 112 are within the threshold distance of the vehicle system 102. For example, the off-board system can determine which of the vehicle systems 112 are within ten kilometers or five miles of the vehicle system 102. The off-board system can then communicate a signal to the controller that identifies these vehicle systems 112. The controller can include these identified vehicle systems in the list that is displayed to the operator.

Optionally, the controller can determine which vehicle systems 112 to include in the list displayed on the input/output device based on which vehicle systems 112 are within a communication range of the vehicle system 102. The monitoring system (and vehicle systems 102, 112) can include a communication device 116. The communication device can represent transceiver and hardware, such as one or more antennas, modems, or the like. The communication devices can allow the controllers of the vehicle systems 102, 112 to communicate with each other and/or the off-board system.

The controller may communicate with other vehicle systems 112 using the communication device. The controller can determine from these communications which vehicle systems 112 are within a communication range of the vehicle system 102. The controller can then direct the input/output device to display the list of these vehicle systems.

The operator can use the input/output device to manually select one or more of the vehicle systems shown on the input/output device as a vehicle-of-interest. Optionally, the controller can automatically select a vehicle system as the vehicle-of-interest. For example, the controller can select the vehicle system that is closest (or closer than one or more other vehicle systems) as the vehicle-of-interest, the vehicle system that is a designated type of vehicle as the vehicle-of-interest, the vehicle system that is moving faster than one or more (or all) other vehicle systems, or the like.

Optionally, the selection of the vehicle-of-interest can be based on an unplanned movement event involving another vehicle. An unplanned movement event may be a change in speed, heading, or the like, that is not planned or scheduled to occur before the event occurs. For example, an unplanned movement event can include a vehicle system making an unscheduled stop, initiating a penalty break application, moving off a planned or scheduled route, experiencing degradation or mechanical failure, experiencing communication degradation or loss, etc.

As another example, the vehicle-of-interest may be selected based on the vehicle-of-interest and the vehicle system having the monitoring system traveling on a common route in the transportation network. This common route is the same route, track, road, or the like. The monitoring system may select the vehicle-of-interest in this way to allow the monitoring system to coordinate movement of the vehicle system 102 with the movement of the vehicle-of-interest for a movement event, as described below.

The vehicle system involved in the unplanned event can communicate a signal to the monitoring system directly or can communicate a signal to the off-board system notifying the off-board system or the monitoring system of the unplanned event. If the signal is sent to the off-board system, the off-board system can inform the controller of the monitoring system of the unplanned event. Based on the reporting of this unplanned event, the controller may identify the vehicle system involved in the unplanned event as the vehicle-of-interest. The controller can select the vehicle having or experiencing an unplanned movement event as the vehicle-of-interest. Optionally, the controller can notify the operator of the vehicle having or experiencing the unplanned movement event and the operator can select this vehicle as the vehicle-of-interest.

Optionally, the selection of the vehicle-of-interest may be based on a model type of the vehicle-of-interest. For example, the operator or controller may select a vehicle system as the vehicle-of-interest based on the vehicle system being one or more designated types of vehicles. A vehicle system may be selected as a vehicle-of-interest when the vehicle system is a maintenance vehicle, is a different type of vehicle than the vehicle system in which the monitoring system is disposed, or the like.

Once the vehicle-of-interest is identified, the controller of the monitoring system can determine where that vehicle system is located. For example, the controller can directly communicate with the vehicle-of-interest to determine where the vehicle-of-interest is located. This direct communication can involve the vehicle systems sending wireless signals to each other via communication devices, cellular towers, repeaters, or the like, but without the signals being acted upon or used by these devices (other than to forward or route the signals).

As another example, the vehicle systems 102, 112 may communicate the locations of the vehicle systems to the off-board system. This off-board system can then provide one or more of these locations to the controller of the monitoring system via the communication device. For example, the controller can send the operator-provided identifier of the vehicle-of-interest to the off-board system. The off-board system can communicate the last known location or last reported location of the identified vehicle-of-interest to the controller.

Figure 5:
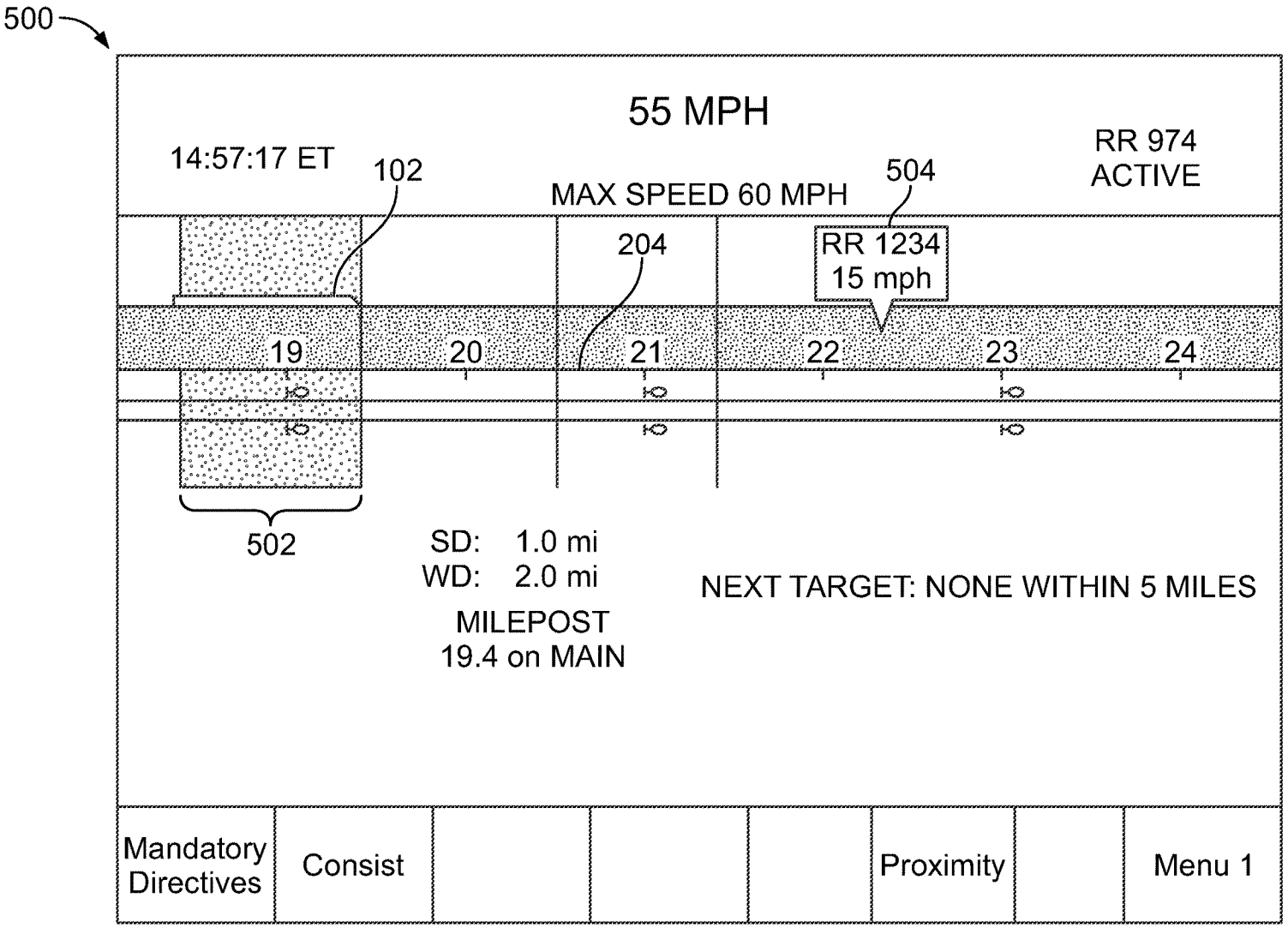
FIG. 5 illustrates another example of a GUI that may be presented by the monitoring system shown in FIG. 1.

FIG. 5 illustrates another example of a GUI 500 that may be presented by the controller on the input/output device onboard the vehicle system 102 shown in FIG. 1. The GUI 500 shows a location 502 of the vehicle system 102 on the route 204. In the illustrated example, this location of the vehicle system is at or near the nineteenth milepost or mile marker along the route. The GUI 500 also shows a state icon 504 representing a notified state of the vehicle-of-interest. The notified state includes information about the vehicle-of-interest as reported by the vehicle-of-interest and/or the off-board system.

The state of the vehicle-of-interest can include the current or last reported location of the vehicle-of-interest. Optionally, the state can include additional or other information about the vehicle-of-interest. This additional or other information can include the unique identifier of the vehicle-of-interest, a speed at which the vehicle-of-interest is moving or was reported as moving, a direction of travel of the vehicle-of-interest, or the like. Although only a single vehicle-of-interest is shown in the GUI 500 in FIG. 5, optionally, the controller may monitor the locations of multiple vehicles of interest and direct the input/output device to display multiple state icons representative of these locations of the multiple vehicles of interest.

The controller of the monitoring system may change display of the state icon representing the vehicle-of-interest on the input/output device. The controller may direct the input/output device to change where the state icon is shown along the route on the GUI responsive to the location of the vehicle-of-interest changing. Optionally, the controller may change how the icon representing the vehicle-of-interest is displayed responsive to not receiving an update to the state or location of the vehicle-of-interest. The controller may determine whether a signal is received from the off-board system and/or the vehicle-of-interest at least once every designated time period, such as every 30 seconds, every minute, every 5 minutes, or the like. Responsive to not receiving an update to the state of the vehicle-of-interest, the controller may direct the GUI to change how the icon representing the vehicle-of-interest is displayed. For example, the controller may direct the input/output device to change a color, size, shape, or the like, of the icon representing the vehicle-of-interest.

Optionally, the controller can direct the input/output device to display a notification to the operator that the state of the vehicle-of-interest has not been updated within the designated time. In one embodiment, the controller can direct the input/output device to stop displaying the icon of the vehicle-of-interest responsive to the state of the vehicle-of-interest in not being updated within the designated time period, responsive to the state of the vehicle-of-interest not being updated within several of the designated time periods, or responsive to the location of the vehicle-of-interest indicating that the vehicle-of-interest is no longer within a designated range or distance of the monitoring system.

In one embodiment, the controller may display a warning message on the input/output device responsive to the state of the vehicle-of-interest changing by more than a designated amount. For example, if the distance between a recently reported location of the vehicle-of-interest and the previously reported location is greater that the threshold distance, the controller may display a warning message on the input/output device to notify the operator of the large change in distance. As another example, if the speed of the vehicle-of-interest changes by more than a threshold amount between reported states of the vehicle-of-interest, the controller may direct the input/output device to display a warning message to the operator.

The controller of the vehicle system 102 and/or the operator of the vehicle system 102 can use the reported state of the vehicle-of-interest to control movement of the vehicle system 102. For example, the vehicle system 102 having the monitoring system 100 may be approaching a movement event that involves or requires the absence of the vehicle-of-interest. One example of a movement of event can be a meet-and-pass event. Another example of such a movement event is an overtake event. Another example of a movement event is a conditional authority event. The vehicle system 102 and/or operator may need to know the state of the vehicle-of-interest to perform or complete the movement event.

Figure 6:
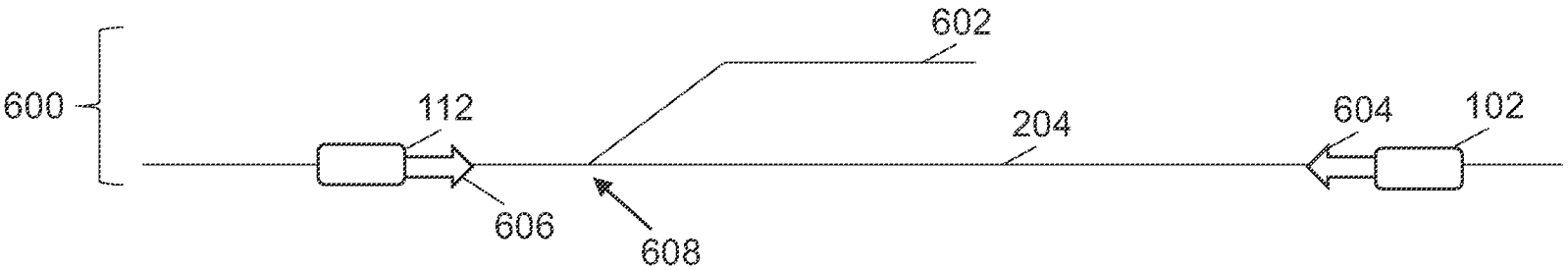
FIG. 6 illustrates a portion of a transportation network in which a meet-and-pass event is to be performed.

FIG. 6 illustrates a portion of a transportation network 600 in which a meet-and-pass event is to be performed. The transportation network includes several interconnected routes on which the vehicle systems may travel. These routes can include tracks, roads, highways, waterways, or the like. FIG. 6 illustrates the route 204 with the vehicle system 102 and a vehicle system 112 identified as a vehicle-of-interest. The route 204 may be referred to as a primary route or mainline route, while an intersecting route 602 may be referred to as a secondary route, a siding route, or another route.

The vehicle system 102 may be heading in a first direction 604 along the primary route 204 (e.g., left in FIG. 6) while the vehicle-of-interest 112 may be moving in an opposite second direction 606 along the route 204 (e.g., right in FIG. 6). The meet-and-pass event includes the vehicle-of-interest leaving the primary route and entering the secondary route to allow the vehicle system 102 to continue on the primary route and pass the vehicle-of-interest. This allows the vehicle system 102 to pass the vehicle-of-interest 102.

The vehicle system 102 can control when the vehicle system 102 arrives at or near an intersection 608 between the primary and secondary routes based on the monitored locations of the vehicle-of-interest. For example, the controller of the vehicle system 102 can monitor the locations of the vehicle-of-interest and determine when or approximately when the vehicle-of-interest will leave the primary route and enter onto the secondary route. The operator and/or controller of the vehicle system 102 can monitor the locations of the vehicle-of-interest to determine whether to speed up or slow down movement of the vehicle system 102. For example, the controller and/or the operator of the vehicle system 102 can control how quickly or slowly the vehicle system travels toward the intersection between the primary and secondary routes to prevent arriving at the intersection too early (before the vehicle-of-interest is able to exit on the secondary route) and having to wait for the vehicle-of-interest to exit onto the secondary route. As another example, the vehicle system 102 may travel toward the intersection more quickly if the vehicle-of-interest arrives and exits onto the secondary route earlier than expected.

Figure 7:
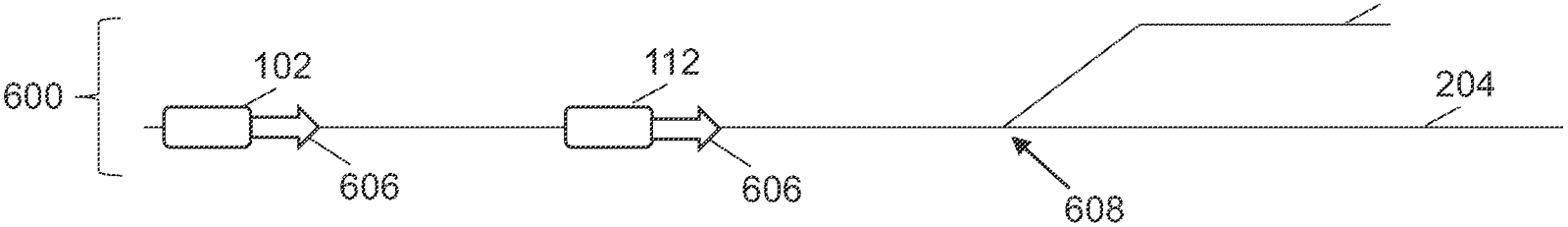
FIG. 7 illustrates an example of an overtake event.

FIG. 7 illustrates an example of an overtake event. In the overtake event, both the vehicle system 102 and the vehicle-of-interest 112 are traveling in the same direction 606 along the primary route toward the intersection with the secondary route. The vehicle system 102 is trailing behind the vehicle-of-interest. The overtake event may involve the vehicle-of-interest exiting the primary route on the secondary route to allow the vehicle system 102 to pass the vehicle-of-interest along the primary route. Similar to the meet-and-pass event, the controller and/or operator of the vehicle system 102 can monitor the locations of the vehicle-of-interest to determine whether to speed up or slow down during the overtake event to avoid arriving at the intersection of the primary and secondary routes too early or later than needed.

Figure 8:
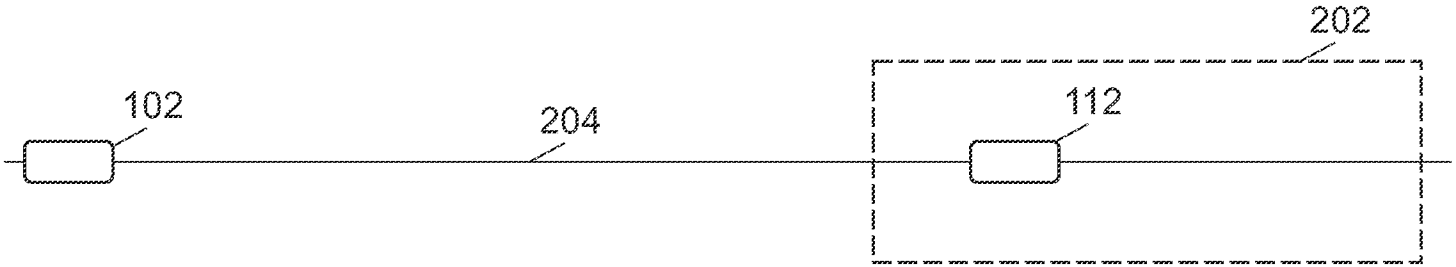
FIG. 8 illustrates one example of a conditional authority event.

FIG. 8 illustrates one example of a conditional authority event. In the conditional authority event, the vehicle system 102 receives a signal from the off-board system informing the vehicle system 102 whether the vehicle system is able to enter into the route segment 202 along the primary route 204. This signal may be sent to the vehicle system 102 once the vehicle-of-interest exits the route segment 202. Unless and until the vehicle-of-interest exits the route segment 202, the vehicle system 102 may not enter the route segment 202. The vehicle system 102 may monitor locations of the vehicle-of-interest to determine when or approximately when the vehicle-of-interest exits the route segment. The controller and/or the operator of the vehicle system may then control the vehicle system to ensure that vehicle system does not arrive too early to the route segment 202 (for example, much earlier than the exit of the vehicle-of-interest from the route segment 202).

Figure 9:
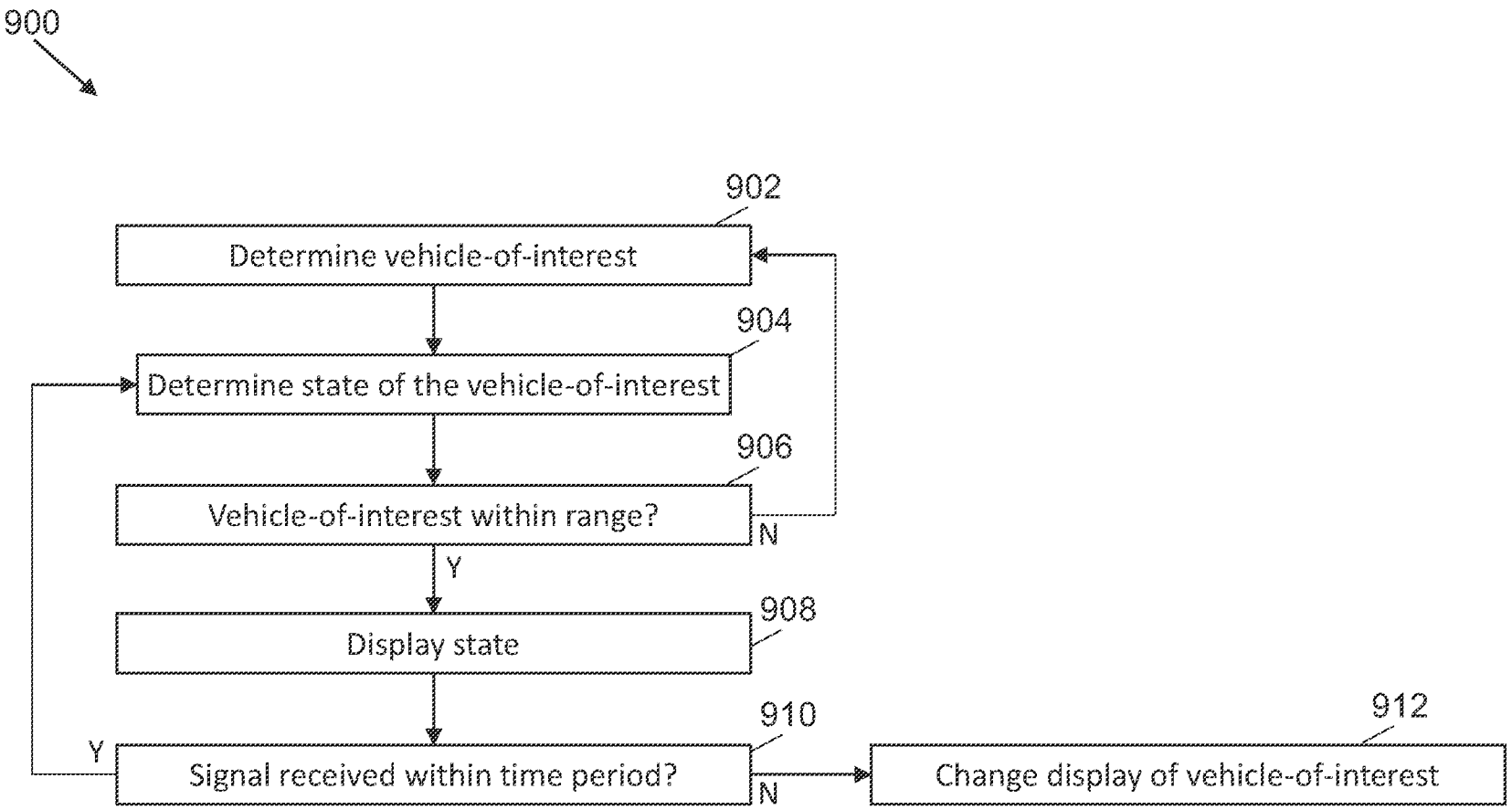
FIG. 9 illustrates a flowchart of one example of a method for monitoring the location of one or more vehicles-of-interest.

FIG. 9 illustrates a flowchart of one example of a method 900 for monitoring the location of one or more vehicles-of-interest. The method 900 can represent operations performed by the controller of the monitoring system shown in FIG. 1. At 902, a vehicle-of-interest is determined. As described herein, the vehicle-of-interest may be identified based on operator input, based on selection from a list of potential vehicles of interest, based on a type of vehicle, based on an unplanned movement event, or the like.

At 904, the location of the vehicle-of-interest as determined. This location can be directly reported from the vehicle-of-interest to the monitoring system. Optionally, the location of the vehicle-of-interest can be monitored by the off-board system and reported to the monitoring system.

At 906, a determination is made as to whether the vehicle-of-interest is within a designated range or distance of the vehicle system having the monitoring system. If the vehicle-of-interest is within this range or distance, then flow of the method 900 can proceed toward 908. But, if the vehicle-of-interest is not within this range or threshold distance, then the location of the vehicle-of-interest may not be displayed or presented onboard the vehicle system 102. As a result, flow of the method 900 can return toward 902.

At 908, the location of the vehicle-of-interest is displayed. For example, the controller of the monitoring system can direct the input/output device to display a GUI with an icon representing the location of the vehicle-of-interest. The location of the vehicle system having the monitoring system optionally made to be displayed so that the operator of the vehicle system 102 can determine how far the vehicle system and the vehicle-of-interest are from each other.

At 910, a determination is made as to whether a signal regarding the state of the vehicle-of-interest has been received within a designated time. For example, the controller may determine whether a signal from the vehicle-of-interest and/or from the off-board system has been received within the last 30 seconds, 1 minute, 5 minutes, or the like. If no signal has been received within this time period, this can indicate that the current state of the vehicle-of-interest may no longer be known, that the vehicle-of-interest has moved outside of a range of the monitoring system, or the like. Responsive to determining that the signal has not been received within the designated time period, the method 900 can proceed toward 912.

At 912, display of the vehicle-of-interest is changed. For example, the icon representing the vehicle-of-interest may change color, size, shape, or the like to visually notify an operator that the displayed state of the vehicle-of-interest has not been recently updated. Optionally, the icon representing the vehicle-of-interest may no longer be displayed. Flow of the method 900 may then terminate or may return back toward the previous operation, such as to 902.

If, on the other hand, the signal informing the monitoring system of the state of the vehicle-of-interest has been received within the designated time period, then flow of the method 900 can return toward 904 from 910. In this way, the method 900 may return in a loop wise fashion to repeatedly determine the location of the vehicle-of-interest and update display of the vehicle-of-interest as needed.

In one embodiment, a method includes receiving a selection of at least one vehicle-of-interest onboard a vehicle system moving along one or more routes in a transportation network. The at least one vehicle-of-interest is disposed on the one or more routes in the transportation network. The method also includes monitoring one or more locations of the at least one vehicle-of-interest from onboard the vehicle system, displaying the one or more locations of the at least one vehicle-of-interest on a display device disposed onboard the vehicle system, and determining whether to change display of the one or more locations of the at least one vehicle-of-interest on the display device based on an update to a notified state of the at least one vehicle-of-interest being received onboard the vehicle system.

Optionally, the method also includes changing operation of the vehicle system based on at least one of: the one or more locations of the at least one vehicle-of-interest or the state of the at least one vehicle-of-interest.

Optionally, the selection of the at least one vehicle-of-interest is received based on one or more of a planned meet-and-pass event or a planned overtake event between the at least one vehicle-of-interest and the vehicle system.

Optionally, the selection of the at least one vehicle-of-interest is received based on the vehicle system and the at least one vehicle-of-interest being located on a common route of the one or more routes.

Optionally, the selection of the at least one vehicle-of-interest is received based on the vehicle system trailing behind the at least one vehicle-of-interest on the common route.

Optionally, the selection of the at least one vehicle-of-interest is received based on the vehicle system moving toward a segment of the one or more routes where the vehicle system has a conditional authority to enter the segment of the one or more routes that is based on an absence of the at least one vehicle-of-interest in the segment of the one or more routes.

Optionally, the selection of the vehicle-of-interest is received based on a prior unplanned event of the at least one vehicle-of-interest.

Optionally, the selection of the at least one vehicle-of-interest is received based on a model type of the at least one vehicle-of-interest.

Optionally, the selection of the at least one vehicle-of-interest is received based on input of an identifier of the at least one vehicle-of-interest.

Optionally, the selection of the at least one vehicle-of-interest is received based on selection of the at least one vehicle-of-interest from a set of potential vehicles provided by an off-board system.

Optionally, the one or more locations of the at least one vehicle-of-interest is monitored from onboard the vehicle system by receiving one or more signals at the vehicle system from the at least one vehicle-of-interest.

Optionally, the one or more locations of the at least one vehicle-of-interest is monitored from onboard the vehicle system by receiving one or more signals at the vehicle system from an off-board system.

Optionally, determining whether to change display of the one or more locations of the at least one vehicle-of-interest is displayed on the display device includes determining whether the one or more locations of the at least one vehicle-of-interest has changed.

Optionally, determining whether to change display of the one or more locations of the at least one vehicle-of-interest on the display device includes changing display of the one or more locations responsive to the update to the notified state of the at least one vehicle-of-interest not being received within a designated period of time.

In one embodiment, a system includes one or more processors configured to determine at least one vehicle-of-interest onboard a vehicle system moving along one or more routes in a transportation network. The at least one vehicle-of-interest is disposed on the one or more routes in the transportation network. The one or more processors are configured to monitor one or more locations of the at least one vehicle-of-interest from onboard the vehicle system and to direct display of the one or more locations of the at least one vehicle-of-interest on a display device disposed onboard the vehicle system. The one or more processors also are configured to determine whether to change display of the one or more locations of the at least one vehicle-of-interest on the display device based on an update to a notified state of the at least one vehicle-of-interest being received onboard the vehicle system.

Optionally, the one or more processors are configured to determine the at least one vehicle-of-interest based on one or more of: a meet-and-pass event between the at least one vehicle-of-interest and the vehicle system, an overtake event between the at least one vehicle-of-interest and the vehicle system, a conditional authority event between the at least one vehicle-of-interest and the vehicle system, the vehicle system trailing behind the at least one vehicle-of-interest, an unplanned event of the at least one vehicle-of-interest, a model type of the at least one vehicle-of-interest, or an identifier of the at least one vehicle-of-interest.

In one embodiment, a system includes one or more processors configured to be disposed onboard a first vehicle system moving along a route. The one or more processors are configured to identify a second vehicle system moving along the route and to monitor a changing state of the second vehicle system based on a signal received from one or more of the second vehicle system or an off-board control system. The one or more processors are configured to direct a display device to present the changing state of the second vehicle system onboard the first vehicle system to an operator of the first vehicle system.

Optionally, the first vehicle system is a rail vehicle system and the one or more processors are configured to direct the display device to present the changing state of the second vehicle system while the second vehicle system remains located within a threshold distance of the rail vehicle system.

Optionally, the one or more processors are configured to control movement of the first vehicle system during a movement event involving the first vehicle system and the second vehicle system based on the changing state of the second vehicle system.

Optionally, the movement event includes one or more of a meet-and-pass event, an overtake event, or a conditional authority event.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

receiving identification of a group of plural nearby vehicles onboard a controller of a vehicle system, the group of the plural nearby vehicles including the vehicles that are within one or more of a threshold distance or a communication range of the vehicle system;

receiving a selection of at least one vehicle-of-interest from among the group of the plural nearby vehicles, the selection received onboard the vehicle system from one or more of an operator of the vehicle system or the controller of the vehicle system;

monitoring one or more locations of the at least one vehicle-of-interest that is selected onboard the vehicle system from onboard the vehicle system;

displaying the one or more locations of the at least one vehicle-of-interest on a display device disposed onboard the vehicle system; and determining whether to change display of the one or more locations of the at least one vehicle-of-interest on the display device based on an update to a notified state of the at least one vehicle-of-interest being received onboard the vehicle system, wherein the selection of the at least one vehicle-of-interest is received based on one or more of a planned meet-and-pass event or a planned overtake event between the at least one vehicle-of-interest and the vehicle system, and wherein the selection of the at least one vehicle-of-interest is received further based on input of an identifier of the at least one vehicle-of-interest.

2. The method of claim 1, further comprising:

changing operation of the vehicle system based on at least one of: the one or more locations of the at least one vehicle-of-interest or the notified state of the at least one vehicle-of-interest.

3. The method of claim 1, wherein the selection of the at least one vehicle-of-interest is received based on the vehicle system and the at least one vehicle-of-interest being located on a common route.

4. The method of claim 3, wherein the selection of the at least one vehicle-of-interest is received based on the vehicle system trailing behind the at least one vehicle-of-interest on the common route.

5. The method of claim 1, wherein the selection of the at least one vehicle-of-interest is received based on the vehicle system moving toward a segment of a route and the vehicle system having a conditional authority to enter the segment of the route based on an absence of the at least one vehicle-of-interest in the segment of the route.

6. The method of claim 1, wherein the selection of the vehicle-of-interest is received based on a prior unplanned event of the at least one vehicle-of-interest.

7. The method of claim 1, wherein the selection of the at least one vehicle-of-interest is received based on a model type of the at least one vehicle-of-interest.

8. The method of claim 1, wherein the one or more locations of the at least one vehicle-of-interest is monitored from onboard the vehicle system by receiving one or more signals at the vehicle system from the at least one vehicle-of-interest.

9. The method of claim 1, wherein the one or more locations of the at least one vehicle-of-interest is monitored from onboard the vehicle system by receiving one or more signals at the vehicle system from an off-board system.

10. The method of claim 1, wherein determining whether to change the display of the one or more locations of the at least one vehicle-of-interest that is displayed on the display device includes determining whether the one or more locations of the at least one vehicle-of-interest has changed.

11. The method of claim 1, wherein determining whether to change the display of the one or more locations of the at least one vehicle-of-interest that is displayed on the display device includes changing the display of the one or more locations responsive to the update to the notified state of the at least one vehicle-of-interest not being received within a designated period of time.

12. The method of claim 1, wherein the off-board system is a back-office server of a positive control system.

13. The method of claim 1, wherein the at least one vehicle-of-interest is a rail vehicle-of-interest, wherein the rail vehicle-of-interest is selected automatically by the controller of the vehicle system based on the at least one rail vehicle-of-interest one or more of changing speed when not scheduled or planned, changing a heading when not scheduled or planned, stopping when not scheduled or planned, performing a penalty break application when not scheduled or planned, moving off a route when not scheduled or planned, experiencing mechanical degradation, or experiencing communication degradation.

14. The method of claim 1, wherein the at least one vehicle-of-interest is selected automatically by the controller of the vehicle system based on the at least one vehicle-of-interest being on a same route as the vehicle system.

15. The method of claim 1, further comprising stopping display of the one or more locations of the at least one vehicle-of-interest on the display device responsive to the controller of the vehicle system not receiving an update on a status of the at least one vehicle-of-interest for at least a designated period of time.

16. A vehicle monitoring system comprising:

one or more processors configured to receive identification of a group of plural nearby vehicles onboard a vehicle system, the group of the plural nearby vehicles including the vehicles that are within one or more of a threshold distance or a communication range of the vehicle system, the one or more processors configured to select at least one vehicle-of-interest from among the group of the plural nearby vehicles; and a display configured to be disposed onboard the vehicle system and configured to display one or more locations of the at least one vehicle-of-interest that is determined, the one or more processors configured to monitor the one or more locations of the at least one vehicle-of-interest from onboard the vehicle system, the one or more processors also configured to determine whether to change display of the one or more locations of the at least one vehicle-of-interest on the display device based on an update to a notified state of the at least one vehicle-of-interest being received onboard the vehicle system, wherein the at least one vehicle-of-interest is a rail vehicle-of-interest, wherein the one or more processors are configured to select the at least one rail vehicle-of-interest based on one or more of:

a meet-and-pass event between the at least one vehicle-of-interest and the vehicle system; or an overtake event between the at least one vehicle-of-interest and the vehicle system.

17. The vehicle monitoring system of claim 16, wherein the one or more processors are configured to select the at least one rail vehicle-of-interest based on one or more of:

a conditional authority event between the at least one vehicle-of-interest and the vehicle system;

the vehicle system trailing behind the at least one vehicle-of-interest;

an unplanned event of the at least one vehicle-of-interest; or a model type of the at least one vehicle-of-interest.

18. A method comprising:

receiving identification of a group of nearby vehicles onboard a controller of a vehicle system, the group of the nearby vehicles including vehicles that are within one or more of a threshold distance or a communication range of the vehicle system;

receiving a selection of plural vehicles-of-interest from among the group of the nearby vehicles, the selection received onboard the vehicle system from one or more of an operator of the vehicle system or the controller of the vehicle system;

displaying a location associated with each of the plural vehicles-of-interest on a display device disposed onboard the vehicle system;

determining whether to change display of the location associated with one or more of the plural vehicles-of-interest on the display device based on an update to a notified state of the one or more of the plural vehicles-of-interest; and changing operation of the vehicle system based on at least one of: the location associated with the one or more of the plural vehicles-of-interest or the notified state of the one or more of the plural vehicles-of-interest, wherein the selection of each the vehicle-of-interest is received based on one or more of a planned meet-and-pass event or a planned overtake event between the vehicle-of-interest and the vehicle system, and wherein the selection of each the vehicle-of-interest is received further based on input of an identifier of the vehicle-of-interest.

* * * * *